US006167855B1

(12) United States Patent
Mammarella et al.

(10) Patent No.: US 6,167,855 B1
(45) Date of Patent: Jan. 2, 2001

(54) INTEGRATED AIR-FUEL MODULE AND ASSEMBLY METHOD

(75) Inventors: John Mammarella, Windsor; Frank Vyskocil, Chatham, both of (CA)

(73) Assignee: Siemens Canada Limited, Ontario (CA)

( * ) Notice: Under 35 U.S.C. 154(b), the term of this patent shall be extended for 0 days.

(21) Appl. No.: 09/329,703

(22) Filed: Jun. 10, 1999

Related U.S. Application Data

(60) Provisional application No. 60/089,094, filed on Jun. 12, 1998.

(51) Int. Cl.[7] ..... F01M 9/10

(52) U.S. Cl. ..... 123/90.38; 123/184.21; 123/184.35; 123/469

(58) Field of Search ..... 123/90.38, 184.21, 123/184.34, 184.35, 469

(56) References Cited

U.S. PATENT DOCUMENTS 5,713,323 * 2/1998 Walsh et al. ..... 123/184.42

* cited by examiner

*Primary Examiner*—Noah P. Kamen

(57) ABSTRACT

An apparatus and method for incorporating a plurality of various fuel and emission components generally located on the top or outside of an internal combustion engine into a completed sub-assembly that can be delivered to an engine assembly line and installed as a unit on the engine. The air-fuel system components are assembled in a unitized or integrated air-fuel module which is then assembled to the engine. Also disclosed is a method of assembling an engine including providing an intake manifold base having at least one valve cover integrally molded in a bottom of the intake manifold base and having integral intake manifold runners; assembling an integrated air-fuel module at a first location; and then attaching the integrated air-fuel module to the engine at a second location.

26 Claims, 6 Drawing Sheets

INTEGRATED AIR-FUEL MODULE AND ASSEMBLY METHOD

This application claims the benefit of priority from provisional patent application serial number 60/089,094, filed Jun. 12, 1998.

FIELD OF THE INVENTION

The invention relates in general to internal combustion engines and in particular to an integrated air-fuel module and assembly method for internal combustion engines.

BACKGROUND OF INVENTION

On internal combustion engines used, for example, in motor vehicles, the air and fuel system component parts such as air intake lines, air cleaners, fuel rails, various emission control devices, and other components are individually assembled to the engine. Individually assembling each component to the engine is a time consuming and labor intensive process.

In the present invention, these air-fuel system components are assembled in a unitized or integrated air-fuel module which is then assembled to the engine.

SUMMARY OF THE INVENTION

It is an object of the invention to provide an apparatus and method for incorporating many of the various fuel and emission components generally located on the top or outside of an internal combustion engine into a completed sub-assembly that can be delivered to an engine assembly line and installed as a unit on the engine.

It is another object of the invention to provide an apparatus and method for reducing the number of components that are normally individually installed on the engine during assembly by a magnitude of about ten, i.e. from about thirty-two to three in a particular application.

It is still a further object of the invention to provide an apparatus and method for reducing the amount of raw material used in building an engine by integrating several individual components into a single component, such as combining the valve covers and the intake manifold base into a single part.

It is yet a further object of the invention to provide an air fuel module with a noise suppression system to reduce engine noise transmitted to the vehicle operator.

These and other objects of the invention are achieved by an integrated air-fuel module comprising an intake manifold base; and at least one valve cover integrally molded in a bottom of the intake manifold base. The integrated air-fuel module may further comprise an air filter mounted on a top of the intake manifold base.

Preferably, the integrated air-fuel module further comprises a throttle body mounted on the top of the intake manifold base and an output tube connected between the throttle body and the air filter. The integrated air-fuel module further comprises a positive crankcase ventilation valve mounted on the intake manifold base.

In one embodiment, the integrated air-fuel module further comprises an exhaust gas recirculation valve, a proportional purge solenoid, and at least one fuel rail each respectively mounted on the intake manifold base. At least one injector is mounted to the at least one fuel rail.

In a preferred embodiment, the integrated air-fuel module further comprises intake manifold runners molded in the intake manifold base and a fuel inlet tube connected to the at least one fuel rail.

In another embodiment, the integrated air-fuel module further comprises a second fuel rail mounted to the intake manifold base and a cross-over fuel tube connecting the two fuel rails.

Preferably, the integrated air-fuel module further comprises a manifold absolute pressure sensor and a charge air temperature sensor each mounted on the intake manifold base.

The integrated air-fuel module further comprises a cover mounted to the intake manifold base and covering substantially all of the intake manifold base including the throttle body. The cover is attached to the intake manifold body by, for example, clips.

In yet another embodiment, the integrated air-fuel module further comprises an electronic control unit mounted to the intake manifold base.

The integrated air-fuel module further comprises an electrical wiring harness mounted to the intake manifold base, the electrical wiring harness comprising an electrical connector at one end and comprising electrical wires respectively connected to the at least one injector, the absolute manifold pressure sensor, the proportional purge solenoid, the throttle body, the exhaust gas recirculation valve, the electronic control unit and the charge air temperature sensor.

Another aspect of the invention is a method of assembling an engine comprising assembling an integrated air-fuel module at a first location; and attaching the integrated air-fuel module to the engine at a second location.

The step of assembling the integrated air-fuel module further comprises providing an intake manifold base having at least one valve cover integrally molded in a bottom of the intake manifold base and having integral intake manifold runners; mounting an air filter on a top of the intake manifold base; mounting a throttle body on the top of the intake manifold base and connecting the throttle body to the air filter with an output tube.

Preferably, the step of assembling the integrated air-fuel module further comprises mounting a positive crankcase ventilation valve, an exhaust gas recirculation valve, a proportional purge solenoid, and at least one fuel rail to the intake manifold base. The assembling step may further comprise mounting a second fuel rail to the intake manifold base and connecting the two fuel rails with a cross-over fuel tube.

In one embodiment, the step of assembling further comprises mounting a manifold absolute pressure sensor, a charge air temperature sensor, an electronic control unit, an oil cap and an oil inlet tube to the intake manifold base.

A cover is mounted to the intake manifold base which covers substantially all of the intake manifold base including the throttle body.

The step of assembling further comprises connecting an electrical wiring harness to at least one injector, the absolute manifold pressure sensor, the proportional purge solenoid, the throttle body, the electronic control unit and the charge air temperature sensor.

Most preferably, the step of providing an intake manifold base includes the step of providing an intake manifold base having two valve covers integrally molded in the bottom of the intake manifold base and further includes the step of molding the intake manifold base in two pieces made of a plastic material and welding the two pieces together to form the intake manifold base.

Further objects, features and advantages of the present invention will become apparent from the following detailed description taken in conjunction with the drawing.

DETAILED DESCRIPTION OF THE PREFERRED EMBODIMENTS

Figure 1:
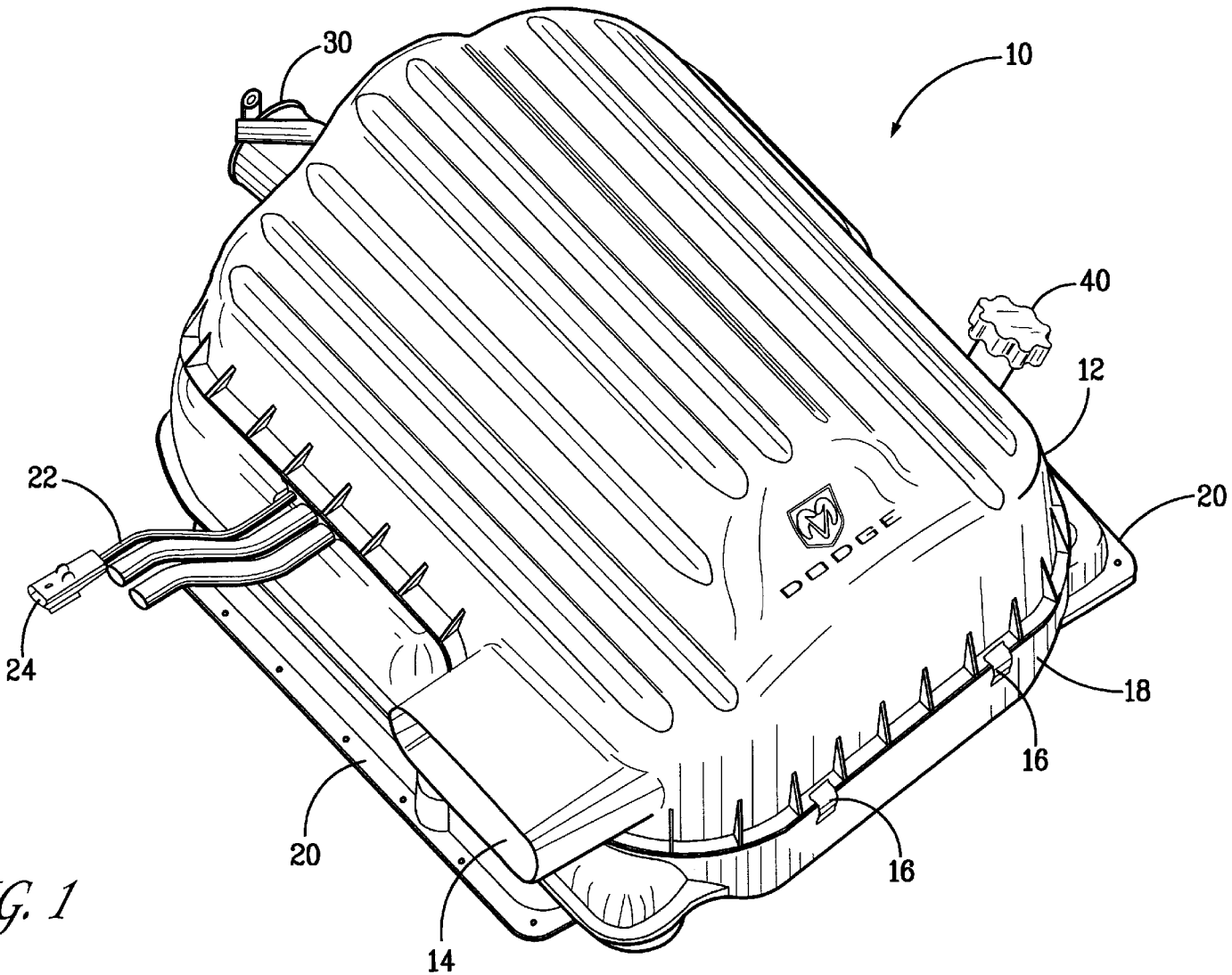
FIG. 1 is a top perspective view of the air-fuel module according to the invention.

The present invention is an apparatus and method for incorporating many of the various fuel and emission components generally located on the top or outside of an internal combustion engine into a completed sub-assembly that can be delivered to an engine assembly line and installed as a unit on the engine. In the present invention, these air-fuel system components are assembled in a unitized or integrated air-fuel module which is then assembled to the engine.

In the Figures, like reference numerals refer to like components.

FIG. 1 is a top perspective view of the air-fuel module 10 of the invention. A cover 12 is attached to an intake manifold base 18 by, for example, clips 16. The cover 12 covers substantially all of the intake manifold base 18. At one end of the cover 12 is an air inlet opening 14 for receiving air to be supplied to an engine, not shown. The intake manifold base 18 includes integral engine valve covers 20. An electrical wiring harness 22 includes a connector 24 for connecting to wiring external to the air-fuel module 10.

The electrical wiring harness 22 contains, among other wiring, the wiring for each injector 26. The number of injectors depends upon the number of cylinders and the number of injectors per cylinder. In the Figures there are illustrated eight cylinders and eight injectors, although more or less cylinders and injectors may be used.

The cover 12 functions as a typical cover by keeping foreign matter out of the module 10. The cover 12 also functions as a noise suppression device because it encompasses substantially the entire top of the intake manifold base 18. The noise suppression ability of the cover may be augmented by attaching resonator pieces (not shown) to the inside of the cover 12. The cover 12 also functions as a cover for the air filter 28 ( FIG. 2 ). The cover is made by, for example molding. The material of the cover is preferably nylon with a glass or mineral filler.

At one end of the module 10 there is an electrical exhaust gas recirculation (EGR) valve 30 for controlling the recirculation of exhaust gas from the exhaust manifold back into the intake manifold. The EGR valve is under the control of an engine electronic control unit (ECU), which in the instant embodiment is not a part of the air-fuel module 10. However, in the embodiment shown in FIGS. 6A and 6B, the ECU is a part of the air-fuel module 10.

Figure 2:
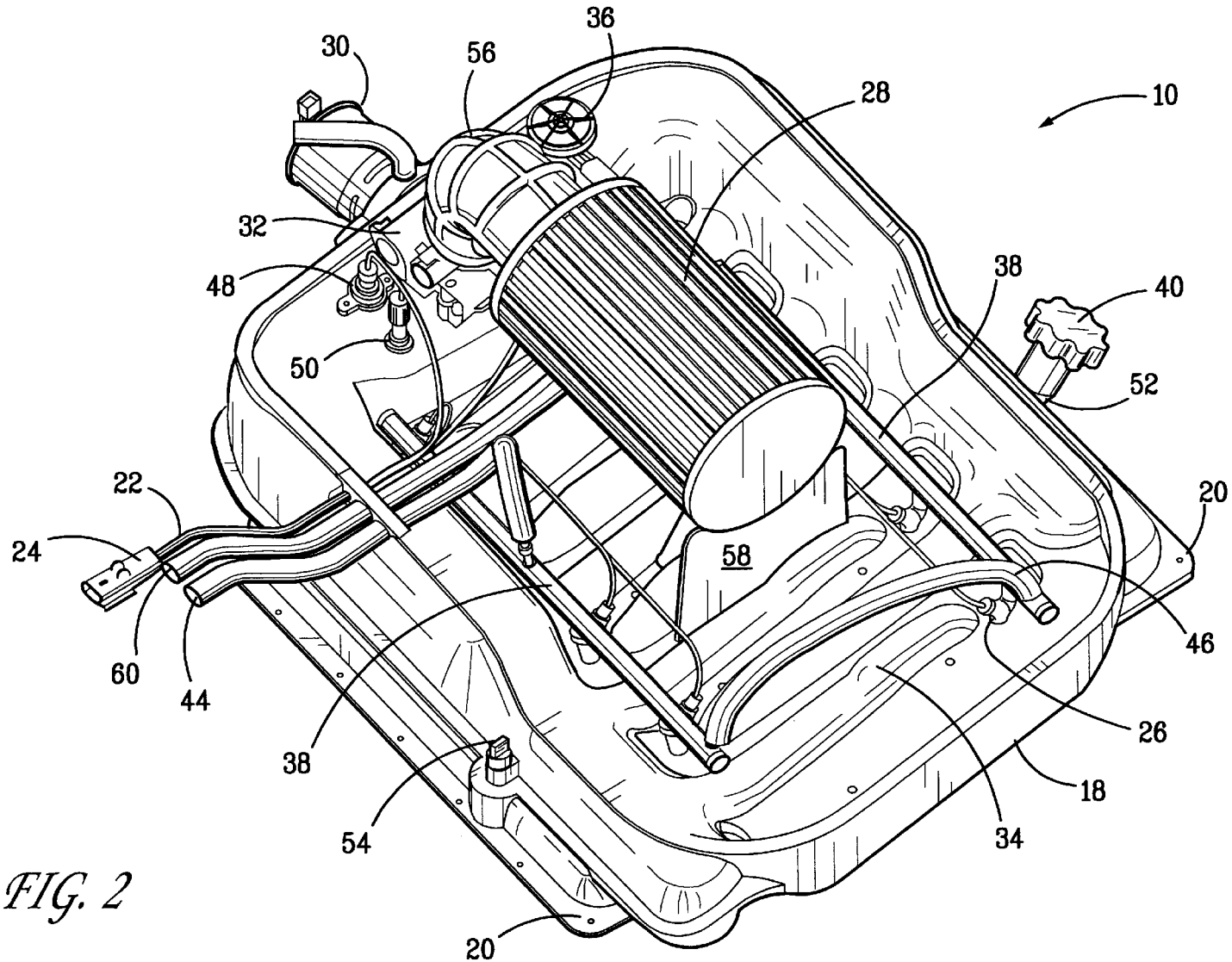
FIG. 2 is a top perspective view of the air-fuel module of FIG. 1 with the cover 12 removed.

FIG. 2 is a top perspective view of the intake manifold base 18 with the cover 12 removed. A cylindrical air filter 28 filters air from the air inlet 14. Air flows from the inlet 14 into the volume enclosed by the cover 12 and then flows radially into the air filter 28 and through to the throttle body 32 and into the intake manifolds runners 34 to the engine.

A proportional purge solenoid 36 is mounted directly on the intake manifold base 18. At least one fuel rail 38 is mounted on the base 18. In the embodiment shown in FIG. 2, there are two fuel rails 38. The fuel injectors 26 are attached to the fuel rails 38 and, in the instant embodiment, there is one injector per cylinder. The fuel rails 38 are connected to an inlet tube 44 and a cross over tube 46. A fuel pressure regulator (not shown) may be mounted external to the integrated air-fuel module 10 or may be mounted in the module 10 by connection to the fuel rail 38.

A manifold absolute pressure (MAP) sensor 48, a charge air temperature sensor 50, an integrated throttle body 32, a positive crankcase ventilation (PCV) valve 54, an oil cap 40 and an oil inlet tube 52 are all mounted to the intake manifold base 18.

The air filter 28 has an output tube 56 connected at one end to direct the flow of clean air into the throttle body 32. The air filter 28 is further supported by a cradle member 58 mounted to the intake manifold base 18 to secure the filter in place. In the preferred embodiment, air enters the air filter 28 any place along the cylindrical surface providing an even air distribution. Such a construction tends to extend the life of the air filter 28.

Figure 3:
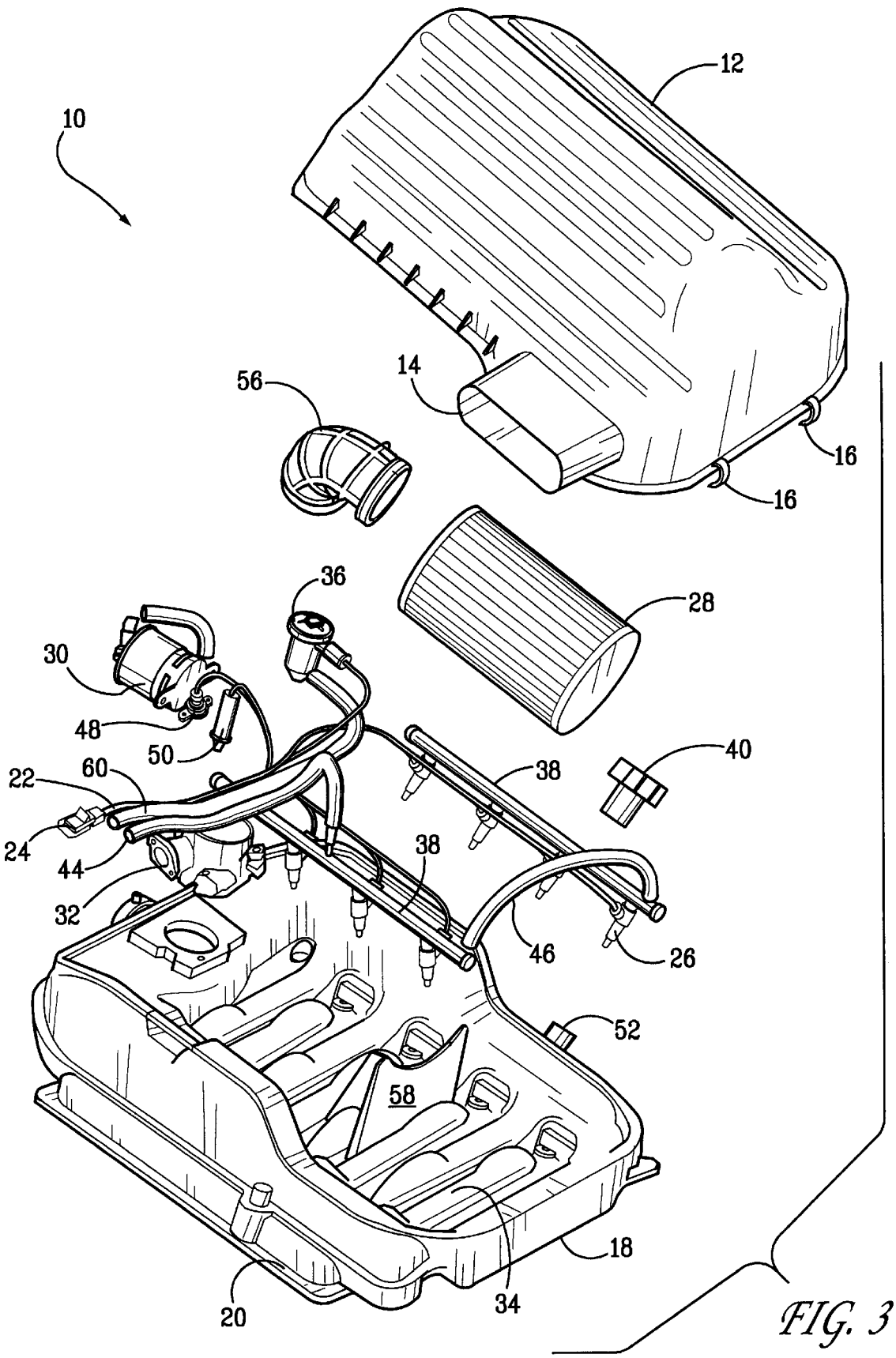
FIG. 3 is an exploded perspective view of the air-fuel module of FIGS. 1 and 2.

FIG. 3 is an exploded perspective view of the air-fuel module 10. An inlet tube 60 leads to the proportional purge solenoid 36. The proportional purge solenoid 36 provides air to purge the fuel vapors from the fuel system. The exhaust gas recirculation valve 30 carries exhaust gas from the exhaust manifold to the intake manifold base 18 for recirculation. The electrical wiring harness 22 has individual wires that connect to the throttle body 32, the manifold absolute pressure sensor 48, the fuel injectors 26, the proportional purge solenoid 36, the exhaust gas recirculation valve 30 and the charge air temperature sensor 50.

Figure 4:
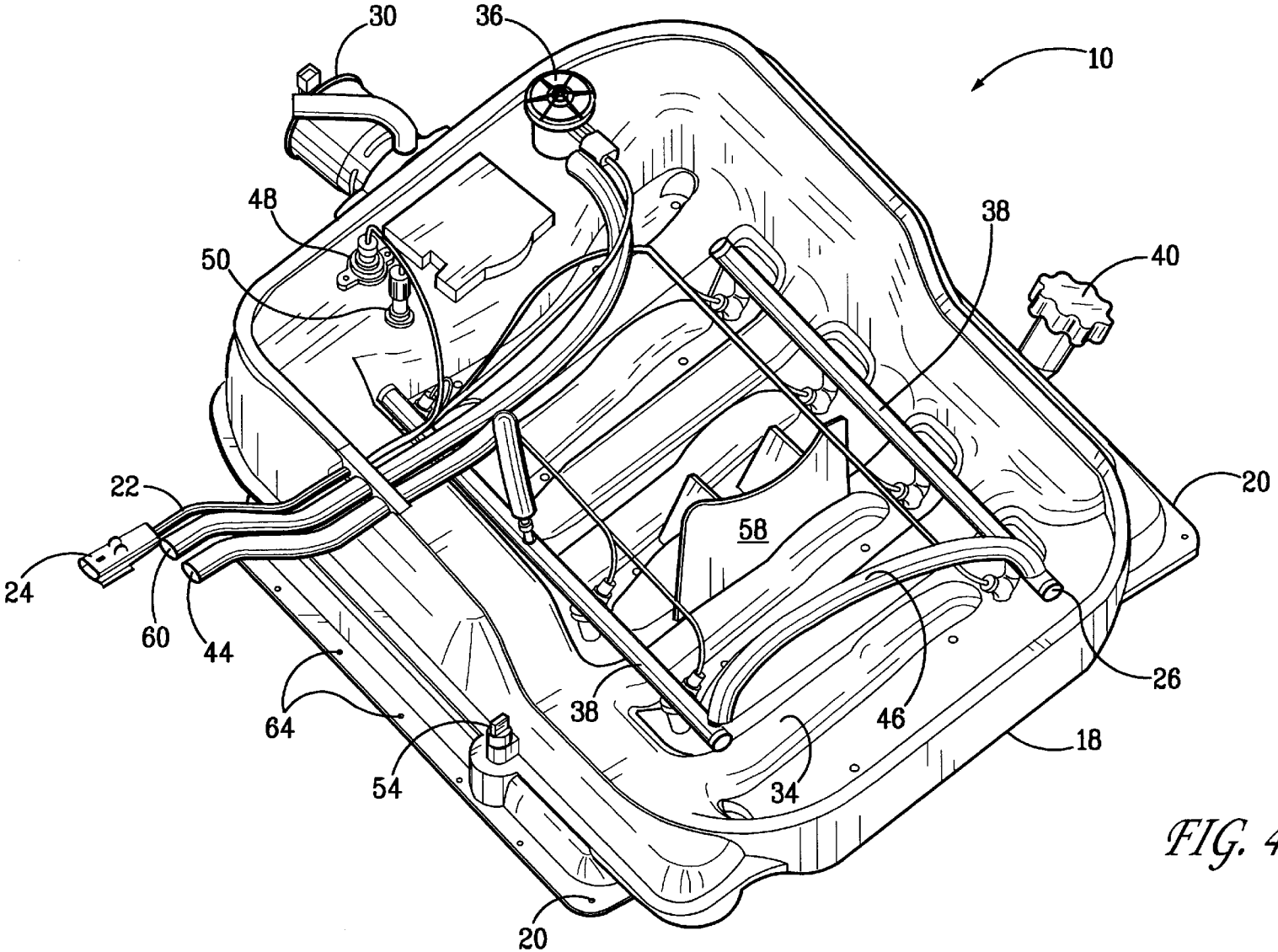
FIG. 4 is a top perspective view of the air-fuel module of FIGS. 1 with the cover 12 and the air cleaner 28 removed.

FIG. 4 is a top perspective view of the intake manifold base 18 showing the valve covers 20 with holes 64 therein for attaching the air-fuel module to the head or heads of the engine with, for example, bolts. In FIG. 4, the air cleaner 28 is removed, thereby more clearly showing the other components of the module 10 as described above with reference to FIGS. 2 and 3.

Figure 5:
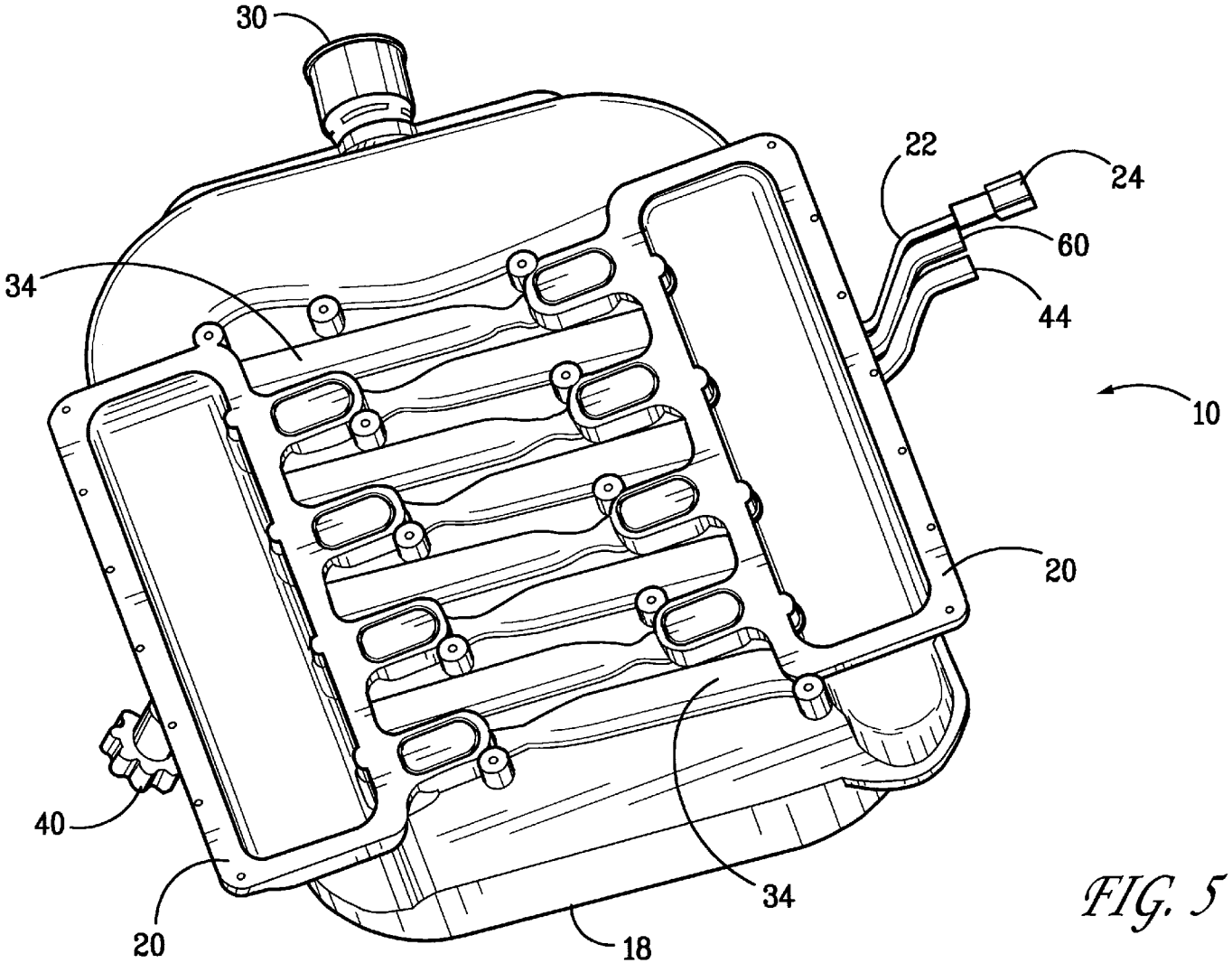
FIG. 5 is a bottom perspective view of the underside of the air-fuel module according to the present invention.

FIG. 5 is a bottom perspective view of the intake manifold base 18. The valve covers 20 and intake manifold runners 34 are integrally molded with the base 18. In FIG. 5, eight intake manifold runners 34 are shown but more or less may be used depending on the number of cylinders in the engine. The intake manifold base is molded in two pieces from a plastic material. The two pieces are joined together by, for example, welding, to form the intake manifold base 18.

Figure 6B:
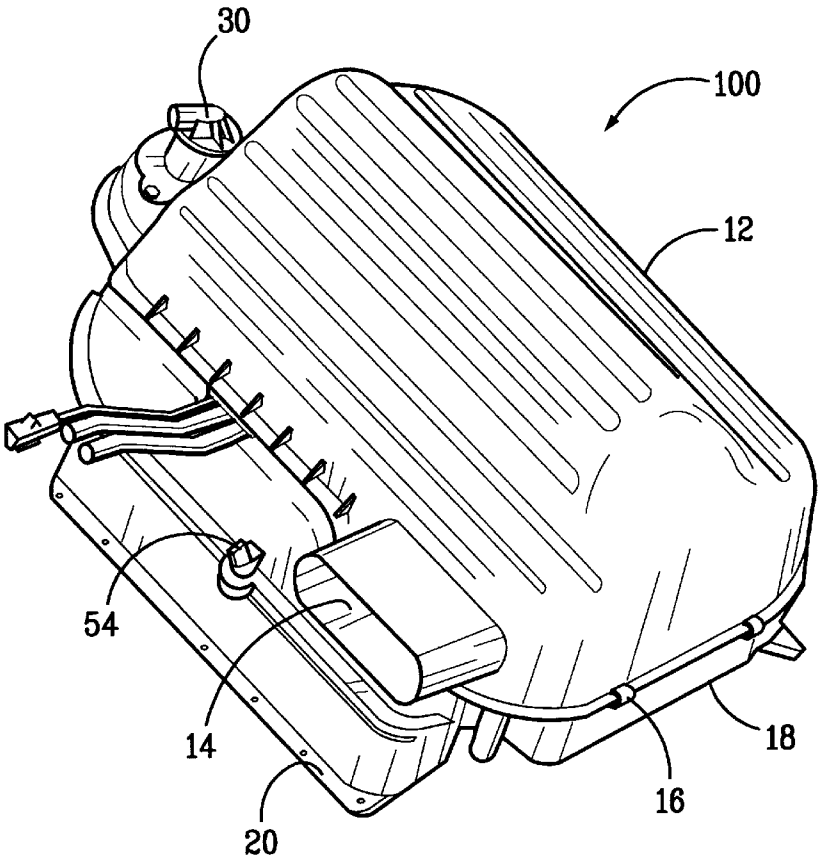
FIGS. 6A and 6B are perspective views of another embodiment of the air-fuel module of the present invention.
Figure 6A:
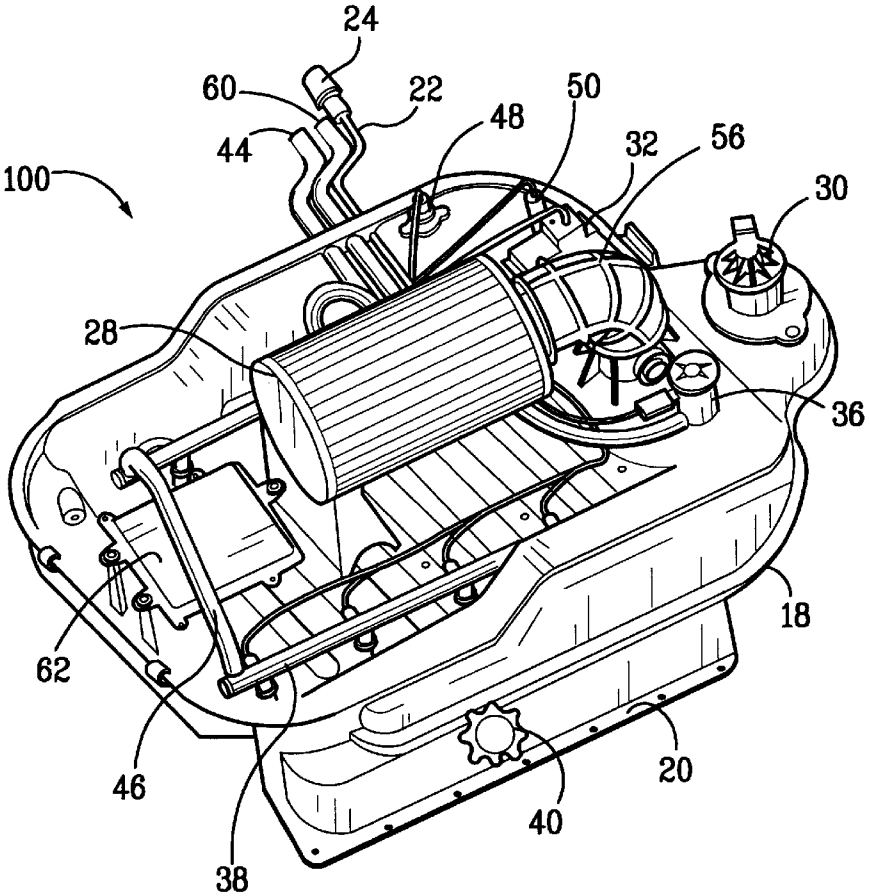

FIGS. 6A and 6B show another embodiment of an air-fuel module 100. In the air-fuel module 100, the electronic control unit 62 ( FIG. 6A) is mounted to the intake manifold base 18 and connected to the wiring harness 22. The other components of the module 100 are the same as described with respect to the module 10 shown in FIGS. 1–5.

Another aspect of the present invention is a method of assembling an engine. The various components of the air-fuel module 10 or 100 need not be assembled on the engine assembly line. The air-fuel module may be assembled at a location distant from the engine assembly line and then transported to the engine assembly line and mounted to the engine. The module 10 or 100 is mounted to the engine by bolting the valve covers to the heads of the engine.

Prior to the integrated air-fuel module of the present invention, a large number of components, for example, thirty-three, with some of the components having separate sub-components, were assembled to an engine on the engine assembly line. The integrated air fuel module of the present invention, being fabricated away from the engine assembly line, reduces the total number of components to be secured to the engine on the assembly line to about three, including the air intake base 18, the cover 12 and an air intake duct. Therefore, the present invention allows the engine assembly line to run at a faster rate. Furthermore, because some of the components are integrally formed in the air-fuel module, for example, the intake manifold and the valve covers, the amount of raw material needed is reduced and the number of steps required to assemble all the components is also reduced.

While the module 10 or 100 described herein is for use on an eight cylinder engine, it is not to be so limited. The module may be used with an engine having any number of cylinders.

While the invention has been described with reference to certain preferred embodiments, numerous changes, alterations and modifications to the described embodiments are possible without departing from the spirit and scope of invention as defined in the appended claims, and equivalents thereof.

What is claimed is:

1. An integrated air-fuel module, comprising:

an intake manifold base; and at least one valve cover integrally molded in a bottom of the intake manifold base.

2. The integrated air-fuel module of claim 1 further comprising an air filter mounted on a top of the intake manifold base.

3. The integrated air-fuel module of claim 2 further comprising a throttle body mounted on the top of the intake manifold base and an output tube connected between the throttle body and the air filter.

4. The integrated air-fuel module of claim 3 further comprising a positive crankcase ventilation valve mounted on the intake manifold base.

5. The integrated air-fuel module of claim 4 further comprising an exhaust gas recirculation valve mounted on the intake manifold base.

6. The integrated air-fuel module of claim 5 further comprising a proportional purge solenoid mounted on the intake manifold base.

7. The integrated air-fuel module of claim 6 further comprising at least one fuel rail mounted on the intake manifold base.

8. The integrated air-fuel module of claim 7 further comprising at least one injector mounted to the at least one fuel rail.

9. The integrated air-fuel module of claim 8 further comprising intake manifold runners molded in the intake manifold base.

10. The integrated air-fuel module of claim 9 further comprising a fuel inlet tube connected to the at least one fuel rail.

11. The integrated air-fuel module of claim 10 further comprising a second fuel rail mounted to the intake manifold base and a cross-over fuel tube connecting the two fuel rails.

12. The integrated air-fuel module of claim 11 further comprising a manifold absolute pressure sensor mounted on the intake manifold base.

13. The integrated air-fuel module of claim 12 further comprising a charge air temperature sensor mounted on the intake manifold base.

14. The integrated air-fuel module of claim 13 further comprising a cover mounted to the intake manifold base and covering substantially all of the intake manifold base including the throttle body.

15. The integrated air-fuel module of claim 14 further comprising clips for attaching the cover to the intake manifold base.

16. The integrated air-fuel module of claim 15 further comprising an electronic control unitmounted to the intake manifold base.

17. The integrated air-fuel module of claim 16 further comprising an electrical wiring harness mounted to the intake manifold base, the electrical wiring harness comprising an electrical connector at one end and comprising electrical wires respectively connected to the at least one injector, the absolute manifold pressure sensor, the proportional purge solenoid, the throttle body, the exhaust gas recirculation valve, the electronic control unit and the charge air temperature sensor.

18. The integrated air-fuel module of claim 17 further comprising an oil cap and oil inlet tube mounted to the intake manifold base.

19. The integrated air-fuel module of claim 2 further comprising a cradle member mounted to the intake manifold base for supporting the air cleaner.

20. A method of assembling an engine comprising: assembling an integrated air-fuel module at a first location; and attaching the integrated air-fuel module to the engine at a second location wherein the step of assembling the integrated air-fuel module further comprises: providing an intake manifold base having at least one valve cover integrally molded in a bottom of the intake manifold base and having integral manifold runners; mounting an air filter on a top of the intake manifold base; mounting a throttle body on the top of the intake manifold base and connecting the throttle body to the air filter with an output tube.

21. The method of claim 20 wherein the step of assembling the integrated air-fuel module further comprises mounting a positive crankcase ventilation valve, an exhaust gas recirculation valve, a proportional purge solenoid, and at least one fuel rail to the intake manifold base.

22. The method of claim 21 wherein the step of assembling further comprises mounting a second fuel rail to the intake manifold base and connecting the two fuel rails with a cross-over fuel tube.

23. The method of claim 22 wherein the step of assembling further comprises mounting a manifold absolute pressure sensor, a charge air temperature sensor, an electronic control unit, an oil cap and an oil inlet tube to the intake manifold base.

24. The method of claim 23 wherein the step of assembling further comprises mounting a cover to the intake manifold base which covers substantially all of the intake manifold base including the throttle body.

25. The method of claim 23 wherein the step of assembling further comprises connecting an electrical wiring harness to at least one injector, the absolute manifold pressure sensor, the proportional purge solenoid, the throttle body, the electronic control unit and the charge air temperature sensor.

26. The method of claim 20 wherein the step of providing an intake manifold base includes the step of providing an intake manifold base having two valve covers integrally molded in the bottom of the intake manifold base and further includes the step of molding the intake manifold base in two pieces made of a plastic material and welding the two pieces together to form the intake manifold base.

* * * * *